US009602935B2

(12) United States Patent
Riepenhoff

(10) Patent No.: US 9,602,935 B2
(45) Date of Patent: Mar. 21, 2017

(54) METHOD FOR OPERATING A HEARING SYSTEM AS WELL AS A HEARING DEVICE

(75) Inventor: Matthias Riepenhoff, Zurich (CH)

(73) Assignee: SONOVA AG, Staefa (CH)

( * ) Notice: Subject to any disclaimer, the term of this patent is extended or adjusted under 35 U.S.C. 154(b) by 0 days.

(21) Appl. No.: 14/409,736

(22) PCT Filed: Jun. 22, 2012

(86) PCT No.: PCT/EP2012/062133
§ 371 (c)(1),
(2), (4) Date: Dec. 19, 2014

(87) PCT Pub. No.: WO2013/189551
PCT Pub. Date: Dec. 27, 2013

(65) Prior Publication Data
US 2015/0382113 A1 Dec. 31, 2015

(51) Int. Cl.
*H04R 25/00* (2006.01)

(52) U.S. Cl.
CPC ..... *H04R 25/558* (2013.01); *H04R 25/505* (2013.01); *H04R 25/554* (2013.01); *H04R 2225/41* (2013.01); *H04R 2225/43* (2013.01); *H04R 2225/55* (2013.01)

(58) Field of Classification Search
CPC ..... H04R 25/00; H04R 25/55; H04R 25/558; H04R 2225/49; H04R 2460/01
USPC ..... 381/312, 315–318, 320–321
See application file for complete search history.

(56) References Cited

U.S. PATENT DOCUMENTS

| | | | | |
|---|---|---|---|---|
| 6,021,207 | A * | 2/2000 | Puthuff | H04B 1/385 381/315 |
| 8,041,062 | B2 | 10/2011 | Cohen | |
| 8,280,086 | B2 * | 10/2012 | Topholm | H04R 25/558 381/315 |
| 2007/0225050 | A1 | 9/2007 | Kaltenbach | |
| 2011/0237295 | A1 | 9/2011 | Bartkowiak | |
| 2011/0319018 | A1 * | 12/2011 | Kroman | H04R 25/554 455/41.1 |

FOREIGN PATENT DOCUMENTS

EP 2 528 356 A1 11/2012

OTHER PUBLICATIONS

International Search Report for PCT/EP2012/062133 dated Feb. 4, 2013.

* cited by examiner

*Primary Examiner* — Suhan Ni
(74) *Attorney, Agent, or Firm* — Pearne & Gordon LLP

(57) ABSTRACT

A method for operating a hearing system includes a hearing device being worn by a hearing device user, at least one communication device being used by a person or by a group of people, and a network. The method includes the steps of establishing a connection between the hearing device and the at least one communication device via the network, identifying the person or the group of people using the at least one communication device, and adjusting settings in the hearing device for adapting its acoustical behavior taking into account acoustic properties of at least one of the person, the group of people, the user, the hearing device and the communication device. Furthermore, a hearing device (2) is described.

10 Claims, 3 Drawing Sheets

METHOD FOR OPERATING A HEARING SYSTEM AS WELL AS A HEARING DEVICE

TECHNICAL FIELD OF THE INVENTION

The present invention is related to a method for operating a hearing system comprising a hearing device as well as to a hearing device. In particular, the present invention is directed to optimizing hearing device settings during a phone call.

BACKGROUND OF THE INVENTION

U.S. Pat. No. 8,041,062 B2 discloses a personal sound system adapted to switching between different input sources according to a priority scheme.

Furthermore, it is known to use other means for providing a telephone signal to a hearing device than by picking-up the acoustic telephone signal by a microphone of the hearing device. For example, it has been proposed to use a T-coil in the hearing device to pick-up the telephone signal. The T-coil is used to transfer the telephone signal via electromagnetic induction to the hearing device. Another known solution is to use data streaming for transferring the telephone signal to the hearing device.

One object of the present invention is to improve intelligibility of sound signals for the hearing device user.

SUMMARY OF THE INVENTION

In connection with the present invention, the term "hearing device" must be understood as a device to improve or correct the hearing of a hearing impaired person. Thereto, a BTE-(Behind-The-Ear), an ITC-(In-The-Canal), a CIC-(Completely-In-the-Canal) or even an implantable device can be used. However, a hearing device can also be used by a person with normal hearing in order to facilitate communication in a noisy environment, for example. Therefore, the term "hearing device" may also be a communication instrument. Furthermore, the term "hearing device" must also be understood to include so called binaural hearing devices that comprise two hearing instruments.

Furthermore, the term "hearing system" must be understood as an arrangement comprising at least one hearing device and a communication device.

The present invention is first directed to a method for operating a hearing system comprising a hearing device being worn by a hearing device user, at least one communication device being used by a person or by a group of people, and a network, wherein the method comprising the steps of:

- establishing a connection between the hearing device and the at least one communication device via the network,
- identifying the person or the group of people using the at least one communication device, and
- adjusting settings in the hearing device for adapting its acoustical behavior taking into account acoustic properties of at least one of the person, the group of people, the user, the hearing device and the communication device.

Taking into account acoustic properties opens up the possibility of significantly improving intelligibility because the settings (i.e. a selected hearing program in the hearing device) can be adjusted accordingly. The acoustic properties can either be technical properties (e.g. used frequency range or frequency response/transfer function of a device of a hearing system, etc.) or individual properties (e.g. voice characteristics—male, female; child, adult—, language used, type of hearing impairment of hearing device user, etc.).

The present invention particularly improves communication abilities of a hearing device user during a phone call because the settings of the hearing device can optimally be adapted to the person who is calling.

In an embodiment of the present invention, the step of establishing the connection is triggered by the at least one communication device or by the hearing device.

In further embodiments of the present invention, the person using the communication device is identified by at least one of the following:

- identification number of the communication device;
- analysis of a signal generated by the communication device;
- analysis of a voice signal of the person using the communication device.

In still further embodiments of the present invention, the step of adjusting the settings is carried out by selecting a predefined setting out of a multitude of available predefined settings, each of which is assigned to a person of a communication device.

Further embodiments of the present invention, further comprise the steps of:

- modifying one or several predefined settings for obtaining modified settings and
- storing the modified settings as new predefined settings.

In further embodiments of the present invention, the connection between the hearing device and the communication device is established via an intermediate device communicating with the hearing device using a near field communication technique.

The present invention is further directed to a hearing device that is worn by a hearing device user. The hearing device comprises:

- in input transducer,
- an output transducer,
- a signal processing unit interconnecting the input transducer and the output transducer, the signal processing unit being at least temporally operatively connected to a network, characterized by

- means for detecting a connection request by at least one communication device,
- means for identifying the person or the group of people using the at least one communication device, and
- means for adjusting settings in the signal processing unit for adapting acoustical behavior taking into account acoustic properties of at least one of the person, the group of people, the user and the at least one communication device.

In addition, the present invention is directed to a hearing device that is worn by a hearing device user. The hearing device comprises:

- in input transducer,
- an output transducer,
- a signal processing unit interconnecting the input transducer and the output transducer, the signal processing unit being at least temporally operatively connected to a network, characterized by

- means for establishing a connection to at least one communication device,
- means for identifying the person or the group of people using the at least one communication device, and means for adjusting settings in the signal processing unit for adapting acoustical behavior taking into account acoustic properties of at least one of the person, the group of people, the user and the at least one communication device.

In further embodiments of the inventive hearing device, the person using the communication device is identified by at least one of the following:

identification number of the communication device;

analysis of a signal generated by the communication device;

analysis of a voice signal of the person using the communication device.

In still further embodiments of the inventive hearing device, the means for adjusting the settings is carried out by selecting a predefined setting out of a multitude of available predefined settings, each of which is assigned to a person of a communication device.

Further embodiments of the inventive hearing device comprise:

means for modifying one or several predefined settings for obtaining modified settings and a memory unit for storing the modified settings as new predefined settings.

Still further embodiments of the inventive hearing device, further comprise means for communicating with an intermediate device using a near field communication technique.

It is pointed out that the above-mentioned embodiments may be combined in any manner. Only those combinations are excluded that would result in a contradiction.

BRIEF DESCRIPTION OF THE DRAWINGS

The present invention is further illustrated by referring to drawings showing exemplified embodiments of the present invention.

DETAILED DESCRIPTION OF THE INVENTION

Figure 1:
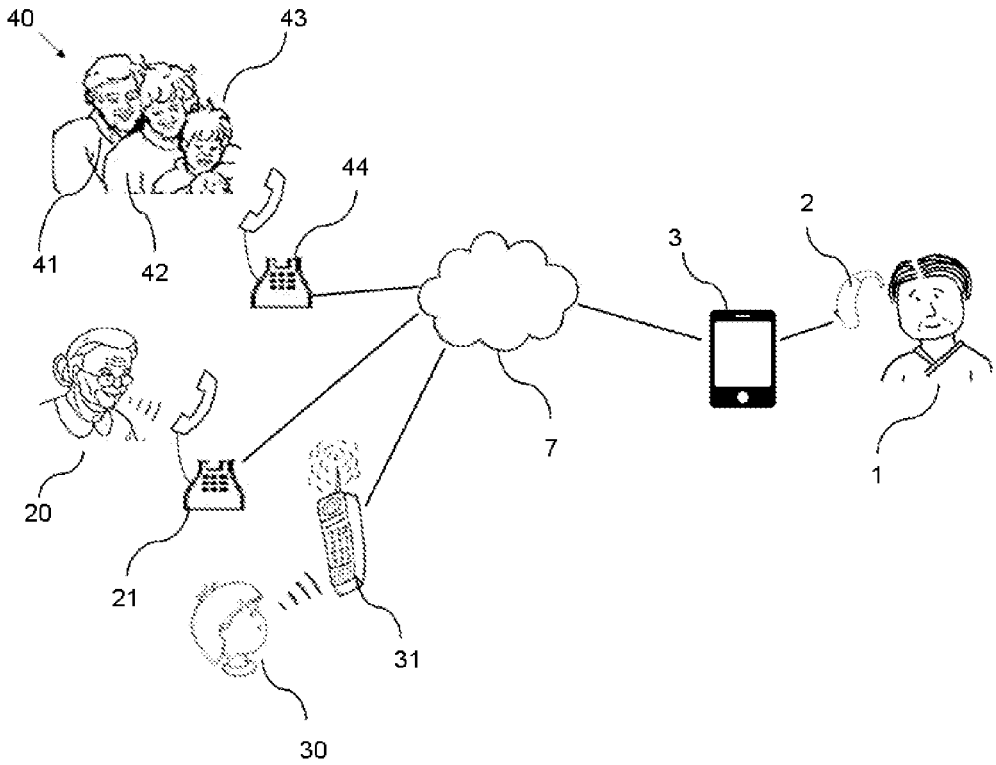
FIG. 1 shows an arrangement with a hearing system according to the present invention comprising a hearing device, an intermediate device and several communication devices.

FIG. 1 shows an arrangement with a hearing system comprising a hearing device 2, an intermediate device 3 and several communication devices 21, 31 and 44. A user 1 is wearing the hearing device 2 in order to improve his hearing capabilities or in order to correct a hearing deficiency due to a hearing impairment, for example. The hearing device 2 is capable of establishing a connection to at least one of the communication devices 21, 31 and 44 via the intermediate device 3 and a network 7. The connection between the hearing device 2 and the at least one communication device 21, 31 and 44 may also be established from one of the communication devices 21, 31 and 44.

While the hearing device 2 may be of any type as defined in the introductory part of this application, the communication device 21, 31 and 44 may be a telephone system of any type, in particular a mobile phone or a regular telephone connected to a public telephone system via wire. The communication device 21, 31 and 44 is worn and operated by a person 20 or 30, or by a group of people 40 comprising several individuals 41 to 43 using the same communication device 44.

As depicted in FIG. 1, the hearing device 2 is connected to the network 7 via the intermediate device 3. However, in a further embodiment of the present invention, the hearing device 2 may very well be directly connected to the network 7. As a result, this embodiment does not comprise an intermediate device 3.

Nevertheless, the presence of the intermediate device 3 may have the advantage of providing an easy input/output control instrument for the user 1. For example, the intermediate device 3 can be a smart-phone or a remote control which is capable to connect to the hearing device 2 wirelessly or via a cable.

According to a further embodiment of the present invention, a multitude of predefined settings (also called hearing programs or sub-programs) are stored in a memory unit (not shown in FIG. 1). The predefined settings can be accessed, as need be, and loaded into a signal processing unit that is capable of processing input signals to the hearing device 2 and generating output signals of the hearing device 2. Thereto, the hearing device 2 comprises the signal processing unit as well as an input transducer, e.g. a microphone, and an output transducer, e.g. a loudspeaker being also called receiver in this technical field.

In case a phone call is arriving for the user 1, the person 20, 30 who is calling is identified and the settings of the hearing device 2 are adapted in order to assist or improve the hearing device user 1 communication capabilities.

The adjustment of the settings in the hearing device 2 may be derived from one or a combination of several of the following possibilities:

an identification number that is transmitted by the calling telephone 21, 31, the identification number being, for example, the phone number, the name in which the phone number is registered or another identification possibility;

a recognition of the calling individual by an analysis of the incoming voice signal, e.g. by using a voice recognition algorithm;

As implied above, a combination of both possibilities is also possible and lead to better identification results in some cases. In addition, it is very well possible that a communication device 40 is used by a group 40 of individuals 41, 42 and 43. For example, members of a family may use the same communication device 44. In order to distinguish between the individuals 41 to 43 additional measures must be taken. Particularly, the recognition of an individual 41, 42, and 43 belonging to a group 40 by analyzing voice signals is rather easy because only a limited number of possible voice characteristics must be monitored. In addition, computing power is also drastically reduced if only a limited number of voice characteristics must be monitored.

This is particularly the case when the phone call is made from a communication device 44 that is associated with a family. The family has several members: father 41, mother 42, and son 43. When a phone call from a family member is incoming, the hearing device 2 may select a setting associated with a single member of the family. The speaking person may then be recognized by a voice recognition method. The voice may be continuously monitored in order to select another setting when the speaking person of the family changes during the call. The recognition of an individual from a small group is easier to obtain than from a large group.

In a further embodiment of the present invention, a calling person may also be identified as a member of a category (man, woman; young, old; language, . . . ) or as an individual 30 or 20 or as a member of a group (family, company, office, . . . ).

Once the step of identification has been concluded and an individual has been unambiguously determined, the settings in the hearing device 2 can be adjusted in order to adapt the acoustical behavior of the hearing device 2. The step of adjusting the settings may now take into account the individual acoustic properties of at least one of the following in order to improve intelligibility of sound signals for the hearing device user:

- person 20, 30, 41 to 43: specific acoustic properties of the person controlling the communication device 21, 31, 44 may be taken into account, e.g. language, pronunciation, dialect or others, in order to adapt the settings of the hearing device 2;
- group 40 of individuals 41 to 43: acoustic properties that are common to all members of the group 40, e.g. language, background noise, etc., may be used for adjusting the settings;
- user 1: an individual hearing loss, if there is any, can be taken into account as well as any other individual acoustical properties;
- type of hearing device 2 he or she is using: depending on the acoustical coupling or other hearing device dependent factors, the settings are adjusted for compensation of these factors;
- type of communication device: a communication device may influence acoustical properties due to insufficient or less perfect signal processing or signal band width.

For example, the settings to be adapted may be at least one of the following:

- frequency filter (male/female voices have different spectral characteristics);
- the voice of one individual is different from the voice from another individual;
- frequency transposition parameters, volume or dynamic compression parameters;
- parameters influencing own voice perception or directivity of microphones.

If no individual setting is associated with an identifier transmitted with the incoming phone call a default setting is loaded. If the settings are changed during the conversation the changed settings might be saved in order to optimize the hearing program. The saving can be executed automatically or upon demand. In the same way, a new individualized setting may be created.

If no individualized setting exists, a default setting is loaded. Voice recognition may then determine whether the person calling belongs to a known category.

The present invention cannot only be used for incoming calls but can very well be also used for outgoing calls. When the user 1 of a hearing device 2 calls another person, the optimized settings, if available, of the person called could be loaded in advance. Therewith, the same advantages apply as the one explained in connection with the use case in which the person controlling the communication device starts the call.

For example, the present invention can be implemented in an accessory device, such as a remote control or a smartphone as well as in the hearing device.

The network 7 which is used to establish the connection between the hearing device 2 and any of the communication devices may be of any network type which is capable of transmitting audio. In addition, some kind of identification must also be transmittable in case the calling person shall be identified by an identification code or number of the communication device. For example, the network 7 can be any type of telephone network or an IP-network.

Figure 2:
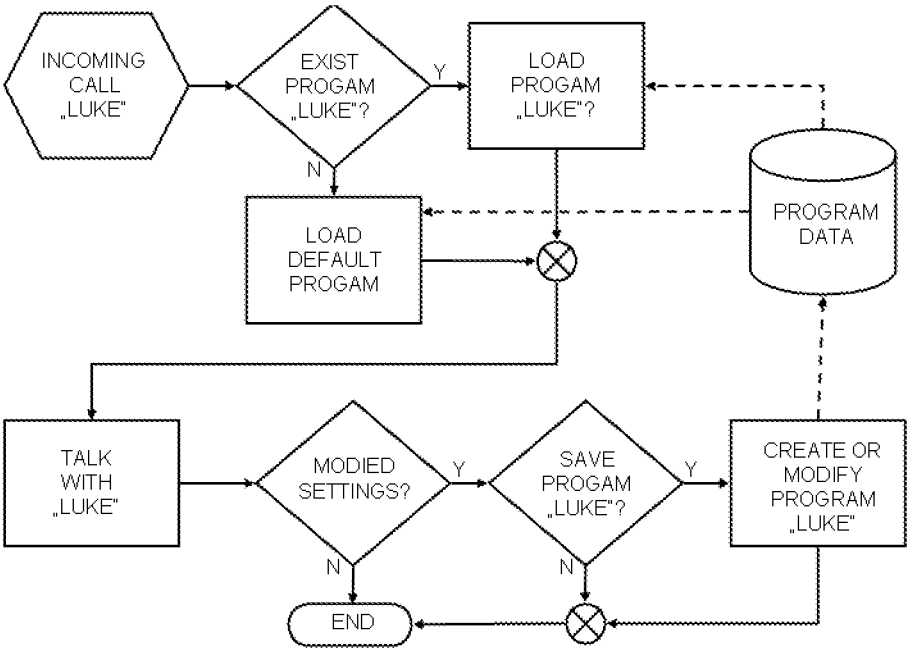
FIG. 2 shows a flow chart illustrating signal flow and decision making in a hearing system according to an embodiment of the present invention, and FIG. 3 schematically shows a block diagram of a hearing device and the intermediate device.

The present invention is further described by a flow chart depicted in FIG. 2. The flow chart illustrates signal flow and decision making in a hearing system, be it implemented in the hearing device itself or in an auxiliary device, such as a remote control or a smart phone.

The flow chart of FIG. 2 described a situation in which an individual called LUKE desires to communicate with a user of a hearing device. The incoming call of LUKE is processed in an input block in which an identification is taking place. If LUKE has been identified and if a setting for LUKE is available, e.g. stored in a memory unit PROGRAM DATA, the setting PROGRAM LUKE is loaded into the signal processing unit in the hearing device for processing audio signals of LUKE. If it has not been possible to identify LUKE or if no setting PROGRAM LUKE has been found in the memory unit PROGRAM DATA, a setting DEFAULT PROGRAM is loaded into the signal processing unit for processing the audio signal.

In either of the above case, it is determined after the phone call of LUKE, whether the settings have been modified by the user during the phone call. In the affirmative, the modified settings PROGRAM LUKE may be stored in the memory unit PROGRAM DATA. In case no setting PROGRAM LUKE could be found in the memory unit PROGRAM DATA, a corresponding setting PROGRAM LUKE can be created in order to use it during future calls of LUKE.

As explained in connection with the above example, the memory unit PROGRAM DATA may contain a large number of predefined settings that can be loaded in accordance with the result of the identification step. Furthermore, these predefined settings may be modified and again stored as modified settings.

Figure 3:
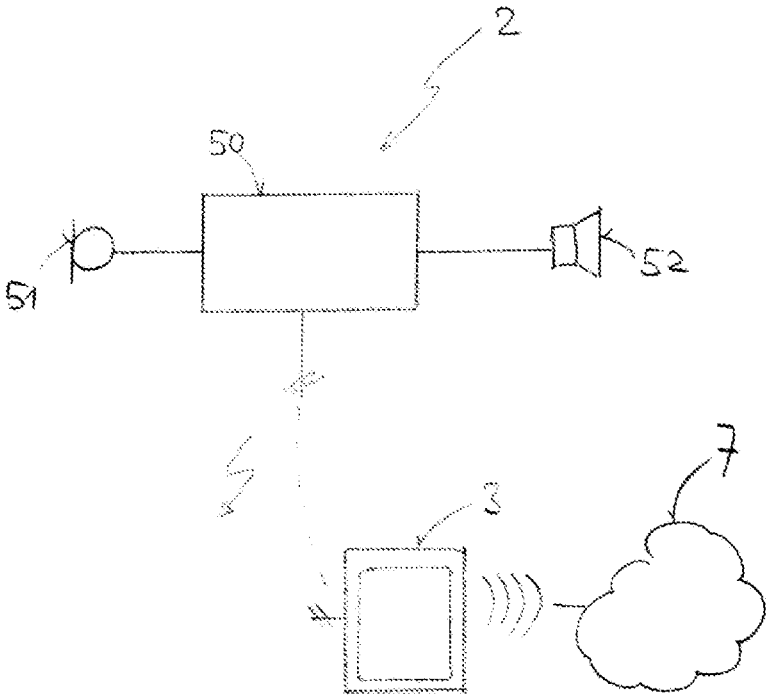

FIG. 3 schematically shows a hearing device 2 comprising an input transducer 51, e.g. a microphone, a signal processing unit 50 and an output transducer 52, e.g. a loudspeaker that is often called receiver in the technical field of hearing device. The input transducer 51 and the output transducer 52 are interconnected by the signal processing unit 50 in which sound signal is processed according to the settings explained above. In addition, the signal processing unit 50 is operatively connectable to the intermediate device 3 either via wireless connection or via cable. The intermediate device 3 is, on the other hand, connectable to the network 7. As already pointed out above, one embodiment of the present invention does not provide for an intermediate device 3. Instead, the hearing device 2 (or its signal processing unit 50) is connectable to the network 7 directly.

While the present invention is disclosed by reference to embodiments and examples detailed above, it is to be understood that these examples are intended in an illustrative rather than in a limiting sense. It is contemplated that modifications and combinations will readily occur to those skilled in the art, which modifications and combinations will be within the spirit of the present invention and the scope of the following claims.

The invention claimed is:

1. A method for operating a hearing system comprising a hearing device, at least one communication device, and a network, the method comprising the steps of:

establishing a connection between the hearing device being worn by a hearing device user and the at least one communication device being used by a person or by a group of people via the network;

identifying the person or the group of people using the at least one communication device; and adjusting setting of the hearing device, thereby adapting the hearing device's acoustical behavior based on the identified person or group of people by taking into account acoustic properties of at least one of the person or the group of people, the user, the hearing device, and the communication device, wherein the person and the group of people are different from the hearing device user, and wherein the step of adjusting the settings is carried out by selecting a predefined setting or settings assigned to the person or the group of people of the at least one communication device.

2. The method of claim 1, wherein the step of establishing the connection is triggered by the at least one communication device or by the hearing device.

3. The method of claim 1, wherein the person using the communication device is identified by at least one of the following:

identification number of the communication device;

analysis of a signal generated by the communication device;

analysis of a voice signal of the person using the communication device.

4. The method of claim 1, further comprising the steps of:

modifying one or several predefined settings for obtaining modified settings and storing the modified settings as new predefined settings.

5. The method of claim 1, wherein the connection between the hearing device and the communication device is established via an intermediate device communicating with the hearing device using a near field communication technique.

6. The method of claim 1, wherein the network is a wide-area network.

7. The method of claim 1, wherein the step of adjusting settings in the hearing device takes into account acoustic properties of the hearing device and the communication device.

8. The method of claim 1, wherein the acoustic properties of the user include the user's language, pronunciation, and dialect preferences.

9. The method of claim 1, wherein the acoustic properties of the hearing device include the hearing device's type and acoustical coupling condition.

10. The method of claim 1, wherein the communication device picks up an acoustic signal of the person or the group of people.

* * * * *